US006406254B1

(12) United States Patent
Itzel et al.

(10) Patent No.: US 6,406,254 B1
(45) **Date of Patent: *Jun. 18, 2002**

(54) COOLING CIRCUIT FOR STEAM AND AIR-COOLED TURBINE NOZZLE STAGE

(75) Inventors: Gary Michael Itzel, Clifton Park; Yufeng Yu, Guilderland, both of NY (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/307,719

(22) Filed: May 10, 1999

(51) Int. Cl.[7] ..... F01D 5/14
(52) U.S. Cl. ..... 415/115; 415/116
(58) Field of Search ..... 415/115, 116, 415/191, 208.1; 416/96 A, 90 R

(56) References Cited

U.S. PATENT DOCUMENTS 5,743,708 A * 4/1998 Cunha et al. ..... 415/115
5,827,043 A * 10/1998 Fukuda et al. ..... 415/115

OTHER PUBLICATIONS

"39th GE Turbine State–of–the–Art Technology Seminar", Tab 1, ""F"Technology—the First Half–Million Operating Hours", H. E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine"A. S. Arrao, Aug. 1996.

"39th GE Turbine State–of–the–Art Technology Seminar", Tab 4, "MWS6001FA—An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderiative Gas Turbines—Design and Operating Features", M. W. Horner, Aug. 1996.

"39th GE Turbine State–of–the–Art Technology Seminar", Tab 7, "Advance Gas Turbine Materials and Coatings", P. W. Schilke, Aug. 1996.

(List continued on next page.)

*Primary Examiner*—Edward K. Look
*Assistant Examiner*—Ninh Nguyen
(74) *Attorney, Agent, or Firm*—Nixon & Vanderhye

(57) ABSTRACT

The turbine vane segment includes inner and outer walls with a vane extending therebetween. The vane includes leading and trailing edge cavities and intermediate cavities. An impingement plate is spaced from the outer wall to impingement-cool the outer wall. Post-impingement cooling air flows through holes in the outer wall to form a thin air-cooling film along the outer wall. Cooling air is supplied an insert sleeve with openings in the leading edge cavity for impingement-cooling the leading edge. Holes through the leading edge afford thin-film cooling about the leading edge. Cooling air is provided the trailing edge cavity and passes through holes in the side walls of the vane for thin-film cooling of the trailing edge. Steam flows through a pair of intermediate cavities for impingement-cooling of the side walls. Post-impingement steam flows to the inner wall for impingement-cooling of the inner wall and returns the post-impingement cooling steam through inserts in other intermediate cavities for impingement-cooling the side walls of the vane.

19 Claims, 5 Drawing Sheets

OTHER PUBLICATIONS

"39th GE Turbine State–of–the–Art Technology Seminar", Tab 8, "Dry Low $NO_x$ Combustion Systems for GE Heavy-Duty Turbines", L. B. Davis, Aug. 1996.
"39th GE Turbine State–of–the–Art Technology Seminar", Tab 9, "GE Turbine Combustion Flexibility", M. A. Davi, Aug. 1996.
"39th GE Turbine State–of–the–Art Technology Seminar", Tab 10, "Gas Fuel Clean–up System Design Considerations for GE Heavy–Duty Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H"Gas Turbine Combined Cycles", Chu et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, "J. R. Johnston, Aug. 1996.
"39th GE Turbine State–of–the–Art Technology Seminar", Tab 16, "Gas Turbine Repair Technology", Crimi et al., Aug. 1996
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Trubine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiencey", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Congeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power Density ™ Steam Turbine Design Evolution", J. H. Moore, Aug. 1996.
"39th GE Turbine State–of–the–Art Technology Seminar", Tab 29, "Advances in Steam Path Technologies", Cofer, IV, et al. Aug. 1996.
"39th GE Turbine State–of–the–Art Technology Seminar", Tab 30, "Upgradable Opportunities for Steam Turbines", D. R. Dreier, Jr. Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivary et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 31, 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2—Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, reprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Faciliyt, Greenville, SC", Document #1753, Feb. 1998, Publication Date: Nov. 17, 1998, Report No. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development "Advanced Turbine Systems Annual Review Meeting, Nov. 7–8, 1996, Washington, D.C., Publication Release.

"H Technology Commercialization", 1998 MarComm Activity Recommendation, Mar., 1998.

"H Technology", Jon Ebacher, VP, Power Gen Technology, May 8, 1998.

"Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficency For GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21st Century—"H" Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D. W. Esbeck, pp. 3013, Oct., 1995.

"Proceedings of the Advanced Turbine Systems Annual Program Review Meeting", vol. I, "H Gas Turbine Combined Cycle", J. Corman, pp. 14–21, Oct., 1995.

"Proceedings of the Advanced Turbine Systems Annual Program Review Meeting", vol. I, "Overview of Westinghouse's Advanced Turbine Systems Program", Bannister et al., pp. 22–30, Oct., 1995.

"Proceedings of the Advanced Turbine Systems Annual Program Review Meeting", vol. I, "Allison Engine ATS Program Technical Review", D. Mukavetz, pp. 31–42, Oct., 1995.

"Proceedings of the Advanced Turbine Systems Annual Program Review Meeting", vol. I, "Advanced Turbine Systems Program Industrial System Concept Development", S. Gates, pp. 43–63, Oct., 1995.

"Proceedings of the Advanced Turbine Systems Annual Program Review Meeting", vol. I, "Advanced Turbine System Program Phase 2 Cycle Selection", Latcovich, Jr., pp. 64–69, Oct., 1995.

"Proceedings of the Advanced Turbine Systems Annual Program Review Meeting", vol. I, "General Electric ATS Program Technical Review Phase 2 Activities", Chance et al., pp. 70–74, Oct., 1995.

"Proceedings of the Advanced Turbine Systems Annual Program Review Meeting", vol. I, "Technical Review of Westinghouse's Advanced Turbine Systems Program", Diakunchak et al., pp. 75–86, Oct. 1995.

"Proceedings of the Advanced Turbine Systems Annual Program Review Meeting", vol. I, "Advanced Combustion Turbines and Cycles: An EPRI Perspective", Touchton et al., pp. 87–88, Oct., 1995.

"Proceedings of the Advanced Turbine Systems Annual Program Review Meeting", vol. I, "Advanced Turbine Systems Annual Program Review", William E. Koop pp.89–92, Oct. 1995.

"Proceedings of the Advanced Turbine Systems Annual Program Review Meeting", vol. I, "The AGTSR Consortium: An Update", Fant et al. pp. 93–102, Oct., 1995.

"Proceedings of the Advanced Turbine Systems Annual Program Review Meeting", vol. I, "Overview of Allison/AGTSR Interactions", Sy A. Ali, pp. 103–106, Oct., 1995.

"Proceedings of the Advanced Turbine Systems Annual Program Review Meeting", vol. I, "Design Factors for Stable Lean Premix Combustion", Richards et al., pp. 107–113, Oct., 1995.

"Proceedings of the Advanced Turbine Systems Annual Program Review Meeting", vol. I, "Ceramic Stationary as Turbine", M. van Roode, pp. 114–147, Oct., 1995.

"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct. 1995.

"Proceedings of the Advanced Turbine Systems Annual Program Review Meeting", vol. I, "Land–Based Turbine Casting Initiative", Mueller et al., pp. 161–170, Oct., 1995.

"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct. 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govazidakia et al., pp. 391–392, Oct., 1995.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry–University Consortium", Lawrence P. Golan, pp. 95–110, Nov., 1996.

"Proceedings of the Advanced Turbine Systems Annual Program Review Meeting", "$NO_x$ and CO Emmisions Models for Gas–Fired Lean–Premixed Combustion Turbines", A. Mellor, pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_x$ Turbines, Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu pp. 461–470, Nov., 1996.
"Proceedings of the Advanced Turbine Systems Annual Program Review Meeting", "Steam as a Turbine Blade Coolant: External Side Heat Transfer", Abraham Engeda, pp. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.
"Proceedings of the Advanced Turbine Systems Annual Program Review Meeting", "Closed–Loop Mist/Steam Cooling for Advanced Turbine Systems", Ting Wang, pp. 499–512, Nov., 1996.
"Proceedings of the Advanced Turbine Systems Annual Program Review Meeting", "Heat Pipe Turbine Vane Cooling", Langston et al., pp. 513–534, Nov., 1996.
"Proceedings of the Advanced Turbine Systems Annual Program Review Meeting", "EPRI's Combustion Turbine Program: Status and Future Directions", Arthur Cohn, pp. 535–552 Nov., 1996.
"Proceedings of the Advanced Turbine Systems Annual Program Review Meeting", "ATS Materials Support", Michael Karnitz, pp. 553–576, Nov., 1996.
"Proceedings of the Advanced Turbine Systems Annual Program Review Meeting", "Land Based Turbine Casting Initiative", Boyd A. Mueller, pp. 577–592, Nov., 1996.
"Proceedings of the Advanced Turbine Systems Annual Program Review Meeting", "Turbine Airfoil Manufacturing Technology", Charles S. Kortovich, pp. 593–622, Nov., 1996.
"Proceedings of the Advanced Turbine Systems Annual Program Review Meeting", "Hot Corrosion Testing of TBS's", Norman Bornstein, pp. 623–631, Nov., 1996.
"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct., 1–Dec. 31, 1996, Publication Date, Jun. 1, 1997, Report Nos.: DOE/MC/31176–13 5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176—10.
"Utility Advanced Turbine System (ATS) Technology Readiness Testing and Pre–Commercial Demonstration, Phase 3", Document #486029, Oct. 1—Dec.31, 1995, Publication Date, May 1, 1997, Report Nos.: DOE/MC/31176—5340.
"Utility Advanced Turbine System (ATS) Technology Readiness Testing and Pre–Commercial Demonstration—Phase 3", Document #486132, Apr. 1—Jun. 30, 1976, Publication Date, Dec. 31, 1996, Report Nos.: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176—5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176—8.
"Utility Advanced Turbine System (ATS) Technology Readiness Testing and Pre–Commercialization Demonstration" Jan. 1–Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Nos.: DE—FC21–95MC31176–23.
"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.
"Utility Advanced Turbine System (ATS) Technology Readiness Testing and Pre–Commercial Demonstration", Annual Technical Progress Report, Reporting Period: Jul. 1, 1995–Sep. 30, 1996.
"Utility Advanced Turbine System (ATS) Technology Readiness Testing", Phase 3R, Annual Technical Progress Report, Reporting Period: Oct. 1, 1997–Sep. 30, 1998.
"Utility Advanced Turbine System (ATS) Technology Readiness Testing", Document #750405, Oct. 1–Dec. 30, 1998, Publication Date: May 1, 1999, Report Nos.: DE–FC21–95MC31176–20.
"Utility Advanced Turbine System (ATS) Technology Readiness Testing", Document #1348, Apr. 1–Jun. 29, 1998, Publication Date Oct. 29, 1998, Report Nos.: DE–FC21–95MC31176—18.
"Utility Advanced Turbine System (ATS) Technology Readiness Testing—Phase 3", Annual Technical Progress Report, Reporting Period: Oct. 1, 1996–Sep. 30, 1997.
"Utility Advanced Turbine System (ATS) Technology Readiness Testing and Pre–Commercial Demonstration", Quarterly Report, Jan. 1–Mar. 31, 1997, Document #666275, Report Nos.:DOE/MC/31176–07.
"Proceedings of the 1997 Advanced Turbine Systems", Annual Program Review Meeting, Oct. 28–29, 1997.

* cited by examiner

COOLING CIRCUIT FOR STEAM AND AIR-COOLED TURBINE NOZZLE STAGE

This invention was made with Government support under Contract No. DE-FC21-95MC31176 awarded by the Department of Energy. The Government has certain rights in this invention.

TECHNICAL FIELD

The present invention relates to land-based or industrial gas turbines, for example, for electrical power generation, and particularly to a cooling circuit for a nozzle stage of the gas turbine.

BACKGROUND OF THE INVENTION

Traditionally, discharge air is extracted from the compressor of a turbine for purposes of cooling turbine blades and nozzles. It has also been recognized that hot gas path components of the gas turbine can be cooled by flowing cooling steam in heat exchange relation with the surfaces to be cooled. Combined steam and air-cooling of nozzles in a gas turbine has been proposed, for example, in U.S. Pat. No. 5,634,766, of common assignee herewith. In that patent, steam is supplied to a plenum in the outer wall containing an impingement plate with openings for flowing steam through the impingement plate openings against the interior wall surface of the outer wall to cool the latter. The steam then flows into a pair of cavities in the vane and particularly through inserts in the cavities having apertures for impingement-cooling of the surrounding interior walls of the vane. The spent impingement steam flows into a plenum in the inner wall for flow through openings in another impingement plate to impingement-cool the inner wall. Return steam flows through cavities containing insert sleeves having openings for impingement-cooling the adjacent walls of the vane. Air-cooling is supplied to a trailing edge cavity for flow through openings in the trailing edge into the hot gas stream.

While that cooling system is satisfactory, experience has shown that thermal barrier coatings on the leading edges of the vanes tend to erode. Very high thermal gradients thus occur when the nozzle leading edge is cooled from the back side without external insulation along the leading edge. Resulting thermal stresses produce a shortfall in low-cycle fatigue lives. Also, because of the high thermal gradients at the leading edge eroded areas, the nozzle requires a leading edge metal thickness with tight tolerances on wall thickness variations. This significantly increases manufacturing costs and produces high scrap rates. Further, the inner and outer walls of the cooling system of U.S. Pat. No. 5,634,766 require covers serving, in part, as manifolds for the steam supplied to the nozzles. The covers are welded to the bands and the weld joint experiences high thermal stress due to the difference in temperature between the cover running at steam temperature in comparison with the temperature of the nozzle bands. There has thus developed a need for a turbine nozzle cooling system which alleviates the above and other problems associated with cooling turbine nozzles.

BRIEF SUMMARY OF THE INVENTION

In accordance with a preferred embodiment of the present invention, combined steam and air-cooling of nozzles are provided, with air-cooling in part being provided by film-cooling in the hot gas path. To accomplish this, each nozzle vane is comprised of a plurality of cavities extending the length of the vane between the leading and trailing edges of the vane. Compressor discharge air is directed through an impingement plate for impingement against the outer wall surface of the outer wall to cool the outer wall. Post-impingement air then flows through cooling holes formed in the outer wall about the vane, producing a layer or film of cooling air on the radially inner wall surface of the outer wall, i.e., forming a film along the outer band wall in the hot gas flow path. Cooling air is also directed through an insert sleeve extending lengthwise in a leading edge cavity of the vane. The insert sleeve has openings for impingement-cooling of the leading edge. Post-impingement cooling air flows outwardly through holes in the leading edge to form a film flow about the leading edge of the vane in the hot gas path. Air also flows in a trailing edge cavity for flow through openings in the side walls of the trailing edge to form a cooling film flow along the side walls of the trailing edge. Air in the cavity also passes through holes in the trailing edge tip for flow outwardly directly into the hot gas path.

Cavities intermediate the leading and trailing edge cavities are provided with steam for cooling the side surfaces of the vane between the inner and outer walls. Particularly, a steam inlet supplies steam through insert sleeves having openings for impingement-cooling the side walls of the vane. The post-impingement steam flows into a plenum in the inner band for flow through an impingement plate to cool the inner wall. The cooling steam then flows outwardly through insert sleeves in the remaining intermediate cavities of the vane for flow through openings for impingement-cooling of the side surfaces of the vane. An outlet for these remaining cavities carries the spent cooling steam. Consequently, thin-film cooling is provided in combination with steam-cooling of the nozzles.

In a preferred embodiment according to the present invention, there is provided a turbine vane segment comprising inner and outer walls spaced from one another, a vane extending between the inner and outer walls and having leading and trailing edges, the vane including a plurality of discrete cavities between the leading and trailing edges and extending lengthwise of the vane for flowing cooling mediums, an impingement plate having openings therethrough and spaced outwardly of the outer wall defining a chamber with the outer wall for receiving cooling air through the impingement plate openings for impingement-cooling the outer wall, the outer wall having a plurality of holes for flowing post-impingement air from the chamber holes therethrough for film-cooling the outer wall along a hot gas path of the turbine and a pair of the cavities comprising cavities adjacent the leading edge and the trailing edge, respectively, for flowing cooling air to cool respective leading and trailing edges, at least two of the plurality of cavities disposed between the leading and trailing edge cavities and having insert sleeves therein, the sleeves extending substantially between the inner and outer walls and having openings therethrough, the inner wall including a plenum and the two cavities lying in communication with one another through the plenum, the outer wall having an inlet for flowing steam into one of the two cavities and an outlet for flowing spent cooling steam from another of the two cavities, the steam in the two cavities flowing through the openings in the insert sleeves for impingement-cooling side walls of the vane.

In a further preferred embodiment according to the present invention, there is provided a turbine vane segment comprising inner and outer walls spaced from one another, a vane extending between the inner and outer walls and having leading and trailing edges, the vane including a plurality of discrete cavities between the leading and trailing edges and extending lengthwise of the vane for flowing cooling mediums, a pair of the cavities comprising cavities adjacent the leading edge and the trailing edge, respectively, for flowing cooling air to cool respective leading and trailing edges, at least two of the plurality of cavities disposed between the leading and trailing edge cavities and having insert sleeves therein, the sleeves extending substantially between the inner and outer walls and having openings therethrough, the inner wall including a plenum and the two cavities lying in communication with one another through the plenum, the outer wall having an inlet for flowing steam into one of the two cavities and an outlet for flowing spent cooling steam from another of the two cavities, the steam in the two cavities flowing through the openings in the insert sleeves for impingement-cooling side walls of the vane, the leading edge cavity including an air inlet, the leading edge having a plurality of holes for flowing cooling air from the leading edge cavity through the holes for film-cooling external surfaces of the leading edge of the vane.

DETAILED DESCRIPTION OF THE INVENTION

Figure 1:
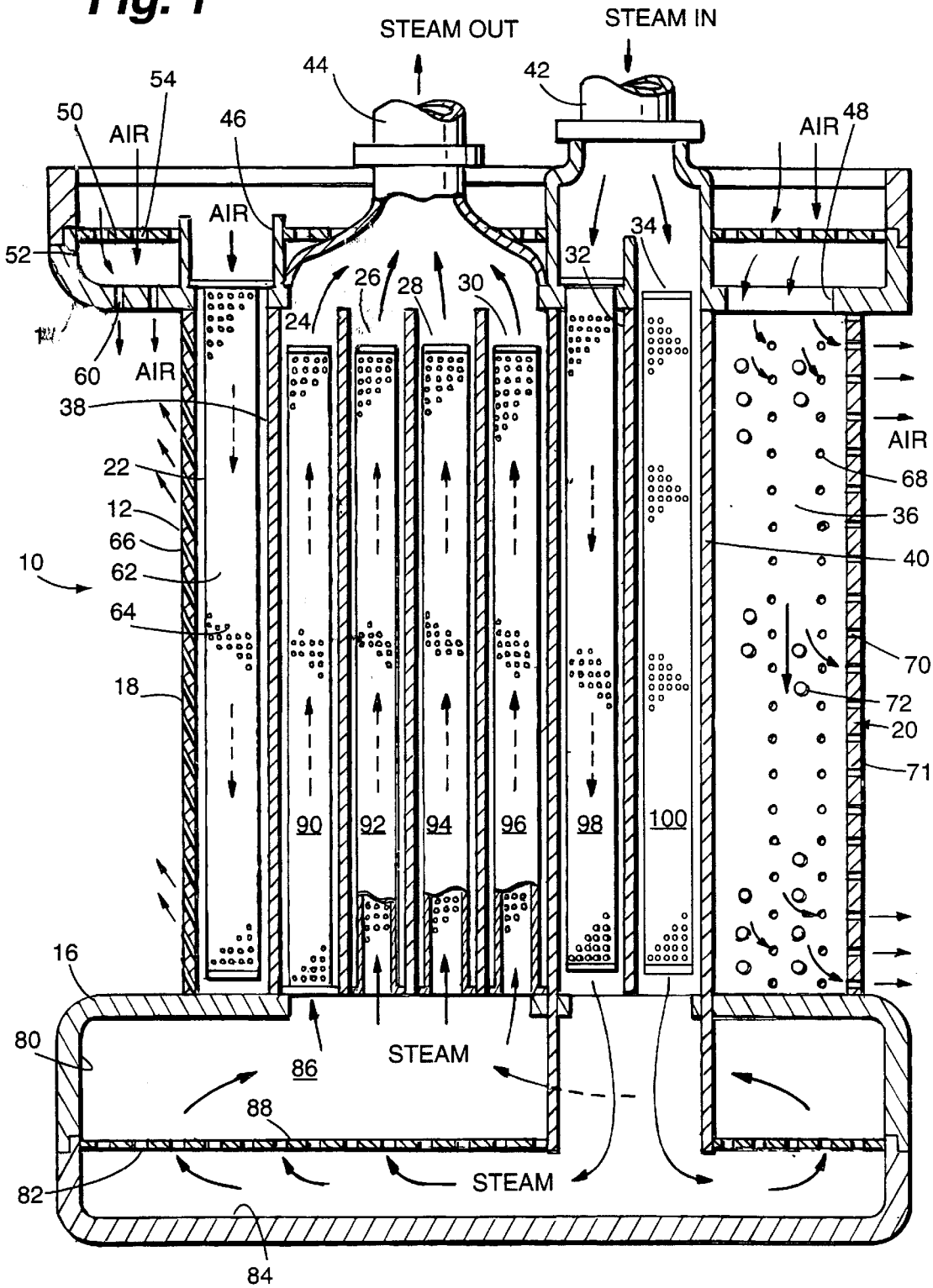
FIG. 1 is a fragmentary cross-sectional view of a nozzle vane illustrating a cooling circuit for a gas turbine in accordance with a preferred embodiment of the present invention.

Referring to FIG. 1, there is illustrated in cross-section a nozzle segment, generally designated 10, forming one of a plurality of nozzle segments arranged in a circumferentially spaced array and forming a turbine stage. Each segment 10 includes a vane 12 and radially spaced outer and inner walls 14 and 16, respectively. The outer and inner walls form circumferentially extending bands defining with the vanes 12 the annular hot gas path through the nozzles of a turbine stage. In the particular arrangement of nozzle segment 10, the outer wall 14 is supported by a shell of the turbine which structurally supports the vane and the inner wall, the segments 10 being sealed one to the other about the nozzle stage. The vane 12 includes a plurality of cavities extending the length of the vane between the respective outer and inner walls 14 and 16 and which cavities are spaced sequentially one behind the other from the leading edge 18 to the trailing edge 20. From the leading edge to the trailing edge, the cavities include a leading edge cavity 22, four successive intermediate cavities 24, 26, 28, 30, a pair of intermediate cavities 32 and 34 and a trailing edge cavity 36. The walls defining the cavities illustrated in cross-section extend between the pressure and suction side walls of the vane 12, the wall 38 extending between the leading edge cavity 22 and the next adjacent cavity 24 being illustrated in FIG. 2. The wall 40 between the trailing edge cavity 36 and the next forward cavity 34 is illustrated in FIG. 3. A steam inlet 42 extends through the outer wall 14 for supplying cooling steam to the intermediate pair of cavities 32 and 34. A steam outlet 44 is provided through the outer wall 14 for receiving spent cooling steam from the intermediate cavities 24, 26, 28 and 30. Each of the leading edge cavity 22 and trailing edge cavity 36 has discrete air inlets 46 and 48, respectively.

Figure 4:
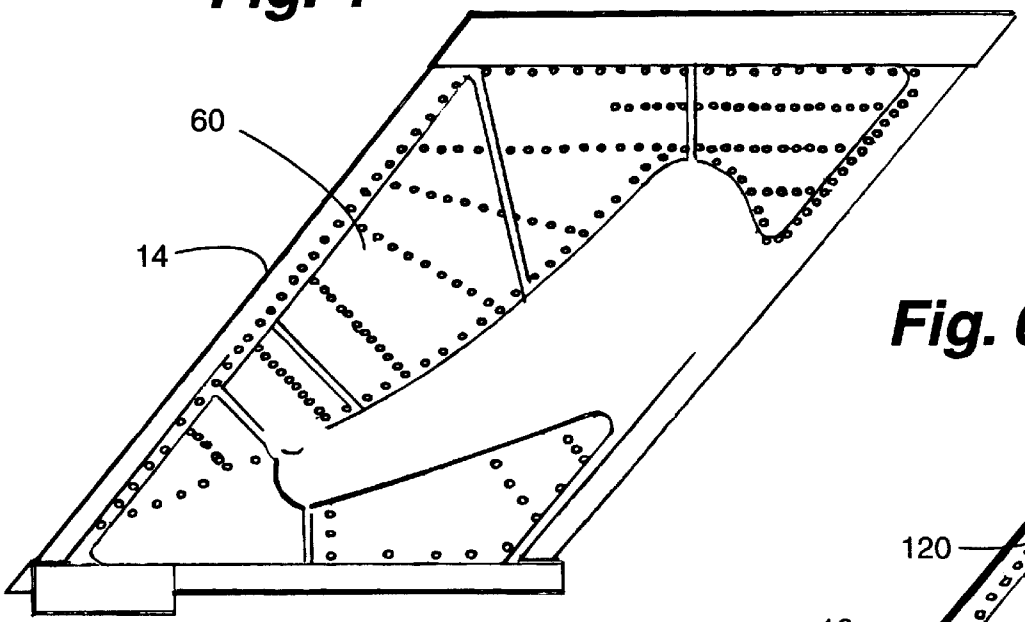
FIG. 4 is a perspective view of the outer wall illustrating holes through the wall affording air-film cooling of the outer wall.

An impingement plate 50 overlies the outer wall 14 in spaced relation thereto defining a chamber 52 between the impingement plate 50 and the outer wall 14. Impingement plate 50 includes a plurality of openings 54. Compressor discharge air is provided along the outer side of the impingement plate 50 for flow through the openings 54 for impingement cooling the outer wall 14. That is, the air flowing through the openings 54 flows against the outer surface of outer wall 14, cooling the outer wall. The spent cooling air then passes through a plurality of holes 60 formed through the outer wall 14 at locations about vane 12. The holes 60 are formed through the outer wall 14 in a pattern, as illustrated in FIG. 4. Thus, the spent impingement cooling air flow passes through the holes 60 forming a thin film of air along the inner surface of the outer wall 14, insulating the outer wall 14 from the hot gases flowing past the vane and the outer wall 14. Compressor discharge air supplied to the impingement plate 50 is also supplied to the air inlets 46 and 48 for the leading and trailing edge cavities 22 and 36, respectively. In a preferred embodiment, the inner ends of cavities 22 and 36 are closed by the inner wall 16.

Figure 2:
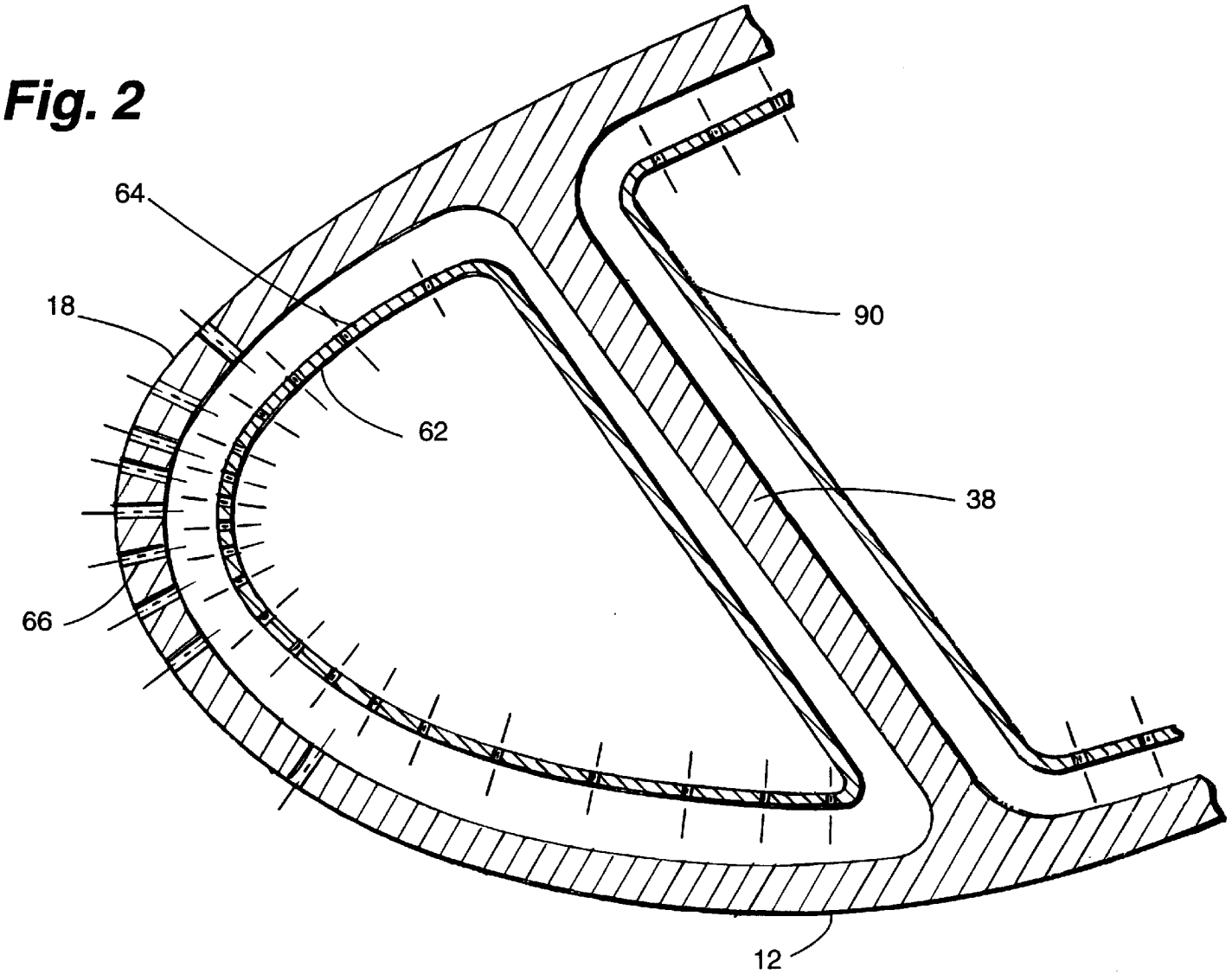
FIG. 2 is an enlarged fragmentary cross-sectional view illustrating the leading edge cavity and an adjacent cavity of the vane.
Figure 3:
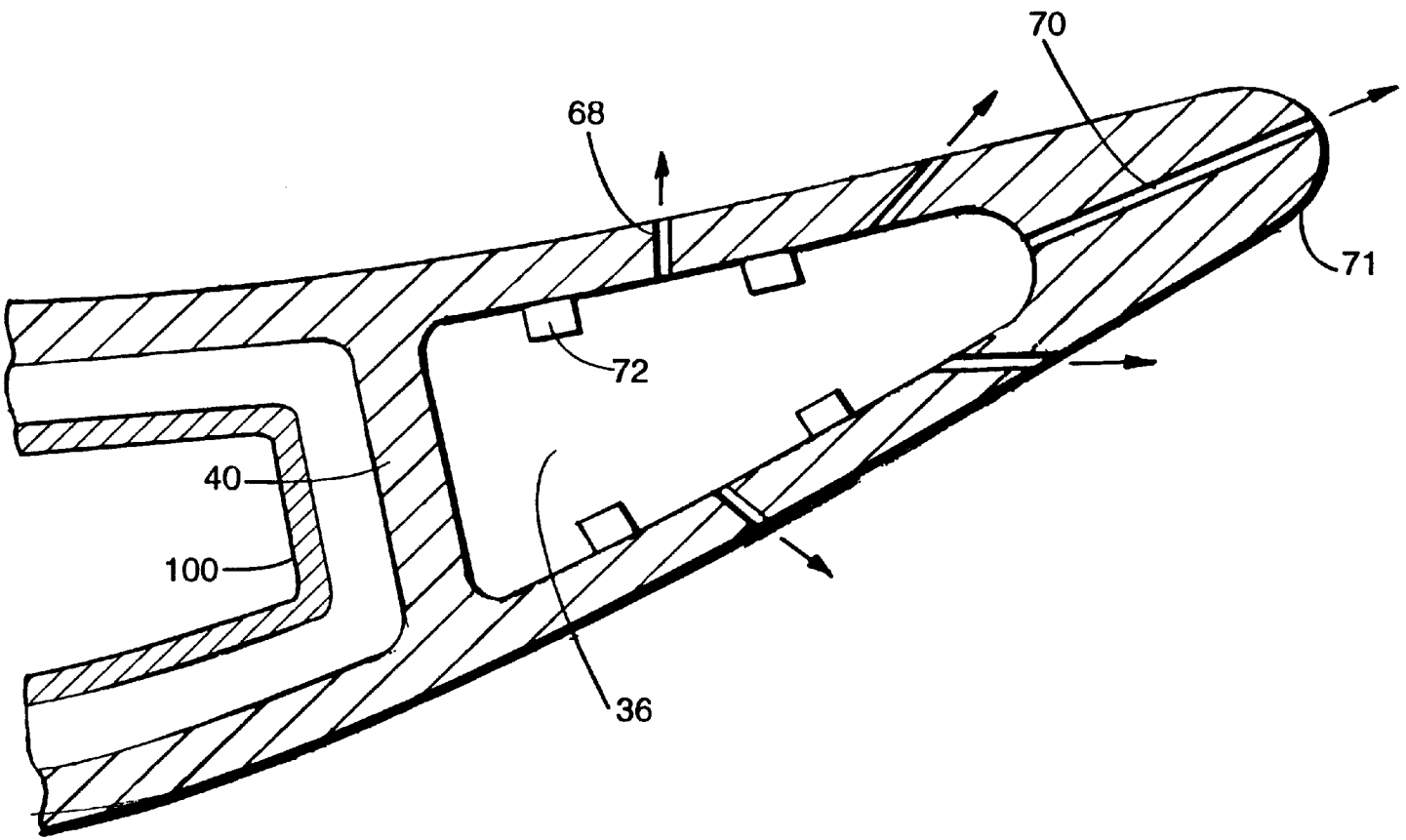
FIG. 3 is an enlarged cross-sectional view illustrating a trailing edge cavity and an adjacent cavity of the vane.

An insert sleeve 62 having a plurality of transverse openings 64 is provided in the leading edge cavity 22 and spaced from the interior walls thereof as illustrated in FIGS. 1 and 2. Air flowing through inlet 46 flows into the sleeve 62 and laterally outwardly through the openings 64 for impingement-cooling of the leading edge 18. Post-impingement cooling air then flows outwardly through holes 66 spaced one from the other along the length of the leading edge 18 and also laterally one from the other, as illustrated in FIG. 2. Consequently, the post-impingement cooling air flowing through holes 66 forms a thin film of air flowing about the leading edge, insulating the leading edge from the hot gases of combustion passing along the vane in the hot gas path of the turbine.

The trailing edge cavity 36 (FIGS. 1 and 3) is provided with a plurality of holes 68 opening laterally through opposite side walls of the vane and along the length of the vane. Holes 70 also pass directly through the trailing edge tip 71 for cooling the trailing edge. Turbulators 72 are provided in the trailing edge cavity 36 for affording turbulence to the air within the cavity and hence increased cooling effect. The turbulators may take the form of pins extending laterally inwardly from the opposite side walls of the vane into the cavity. The turbulators may take forms other than pins, for example, laterally projecting bars or ribs. Thus, cooling air passing through the impingement plate 50 and through chamber 52 passes through the air inlet 48 into the trailing edge cavity 36. Turbulence is caused in the trailing edge cavity by turbulators 72 for efficiently cooling the side walls of the cavity. Additionally, the air passes through the lateral holes 68 forming a thin film of insulating air external about the side walls of the trailing edge and in the hot gas path. Additionally, the holes 70 pass air directly from the cavity 36 into the hot gas path, cooling the trailing edge as the air passes through holes 70.

Inner wall 16 includes a plenum 80 which is divided by an impingement plate 82 into a first chamber 84 and a second chamber 86. Impingement plate 82, like impingement plate 50, has a plurality of openings 88. Unlike plate 50, impingement plate 82 transmits steam from the first chamber 84 to the second chamber 86 for impingement cooling of the inner wall 16 using steam as the cooling medium. From a review of FIG. 1, it will be appreciated that each of the cavities 24, 26, 28, 30, 32 and 34 has an insert sleeve 90, 92, 94, 96, 98 and 100, respectively, each sleeve having a plurality of openings as illustrated. The sleeves are suitably fixed within the cavities and are spaced from the walls of the cavities. Cooling steam enters the steam inlet 42 for flow inwardly through the insert sleeves 98 and 100 in the pair of cavities 32 and 34, respectively. Steam flows through the lateral openings of the insert sleeves 98 and 100 and impinges against the side walls of the vane to cool those walls. The post-impingement cooling steam flows into the plenum 80 of the inner wall directly into the chamber 84. The steam then flows through the openings 88 of the impingement plate for cooling the wall portions of inner wall 16 surrounding the vane. The post-impingement cooling steam then flows outwardly through the sleeves 90, 92, 94 and 96 of the cavities 24, 26, 28 and 30, respectively, and through the openings in those sleeves for impingement-cooling the side walls of the vane 10 between the inner and outer walls. The spent cooling steam flows from the outer ends of the sleeves through the steam outlet 44 to a steam supply or for use in driving turbines in a combined cycle system.

Figure 5:
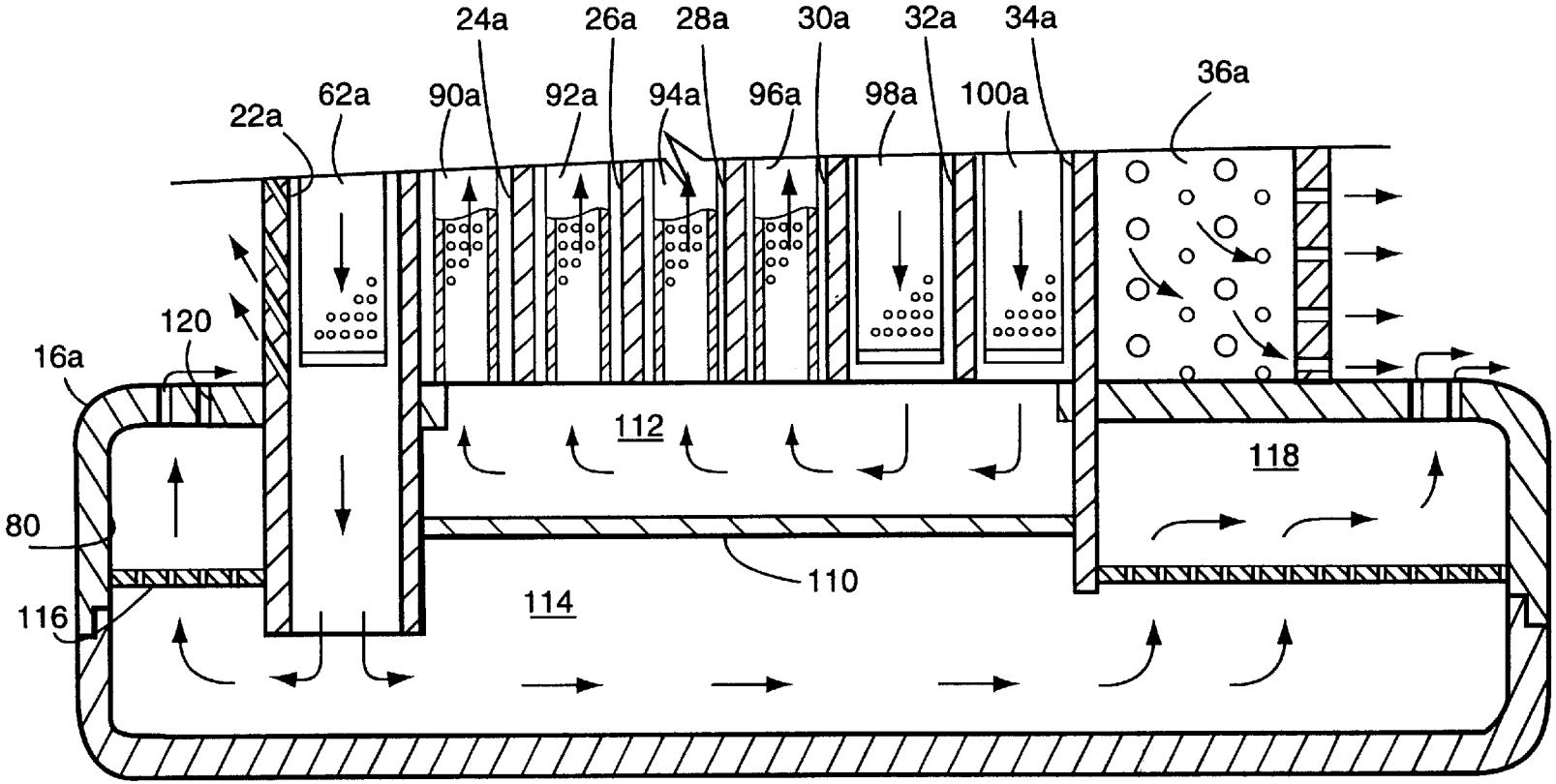
FIG. 5 is a cross-sectional view similar to FIG. 1 illustrating a further embodiment of the invention.

Referring now to FIG. 5, there is illustrated a further form of the present invention wherein like reference numerals as in the embodiment of FIGS. 1–4 apply to like parts followed by the suffix "a." In this embodiment, the outer portion of the nozzle is similar to the nozzle of FIG. 1. However, in this embodiment, the inner wall 16*a* is air-cooled rather than steam-cooled and film-cooling is provided along the inner wall. In this form of the invention, the steam-cooling circuit includes a direct passage between the pair of cavities 32*a* and 34*a* and the steam return cavities 24*a*, 26*a*, 28*a* and 30*a*. Particularly, the direct passage includes a bottom wall 110 defining a chamber 112 in communication with the outlets from cavities 32*a* and 44*a* and with the inlets to cavities 24*a*, 26*a*, 28*a* and 30*a*. Thus, the cooling steam flows into the inner wall plenum 80*a*, particularly chamber 112 thereof, for direct return through the vane without cooling the inner wall.

Figure 6:
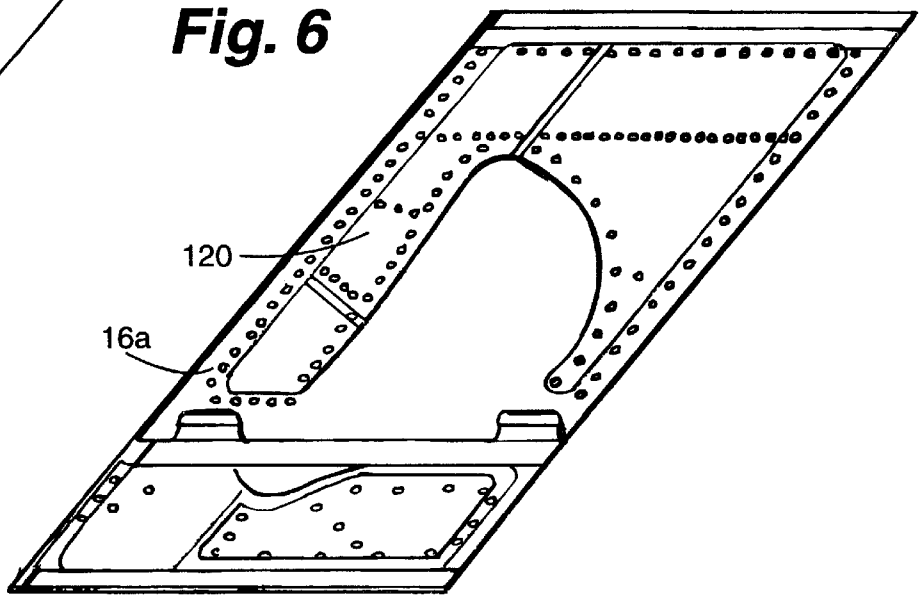
FIG. 6 is a perspective view of the inner wall illustrating holes therethrough for air-film cooling of the inner wall in the embodiment of FIG. 5.

To cool the inner wall, cooling air provided in the leading edge cavity 22*a* flows into a first chamber 114 in the plenum 80*a* of the inner wall 16*a* for passage through the openings of an impingement plate 116. Plate 116 divides plenum 80*a* into an inner chamber 114 and outer chamber 118. The air thus serves to impingement-cool the inner wall 16*a*. The post-impingement cooling air also flows through holes 120 (FIG. 6) formed in the inner wall forming thin-film cooling along the inner wall surfaces exposed to the hot gas path.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine vane segment comprising:

inner and outer walls spaced from one another;

a vane extending between said inner and outer walls and having leading and trailing edges, said vane including a plurality of discrete cavities between the leading and trailing edges and extending lengthwise of said vane for flowing cooling mediums;

an impingement plate having openings therethrough and spaced outwardly of said outer wall defining a chamber with said outer wall for receiving cooling air through said impingement plate openings for impingement-cooling the outer wall;

said outer wall having a plurality of holes for flowing post-impingement air from said chamber holes therethrough for film-cooling the outer wall along a hot gas path of the turbine; and a pair of said cavities comprising cavities adjacent said leading edge and said trailing edge, respectively, for flowing cooling air to cool respective leading and trailing edges;

at least two of said plurality of cavities disposed between said leading and trailing edge cavities and having insert sleeves therein, said sleeves extending substantially between said inner and outer walls and having openings therethrough, said inner wall including a plenum and said two cavities lying in communication with one another through said plenum;

said outer wall having an inlet for flowing steam into one of said two cavities and an outlet for flowing spent cooling steam from another of said two cavities, the steam in said two cavities flowing through said openings in said insert sleeves for impingement-cooling side walls of said vane.

2. A segment according to claim 1 wherein said leading edge cavity includes an air inlet, said leading edge having a plurality of holes for flowing cooling air from said leading edge cavity through said holes for film-cooling external surfaces of the leading edge of said vane.

3. A segment according to claim 2 wherein said holes are angled relative to the length of said vane.

4. A segment according to claim 2 including an insert sleeve within said leading edge cavity spaced from interior wall surfaces of said leading edge and in communication with said air inlet, said insert sleeve having a plurality of openings therethrough for flowing air received from said leading edge cavity inlet through said sleeve openings into the space between said sleeve and said interior wall surfaces for impingement-cooling said interior wall surfaces of said leading edge prior to flowing cooling air through the holes of said leading edge for film-cooling the exterior surfaces of the leading edge of the vane.

5. A segment according to claim 1 including an air inlet to said trailing edge cavity for flowing cooling air into said trailing edge cavity, said trailing edge having a plurality of holes spaced from one another along the length of the trailing edge in communication with the air in said trailing edge cavity for film-cooling exterior trailing edge surfaces of said vane.

6. A segment according to claim 5 wherein said trailing edge has a tip along the length of said vane, and a plurality of holes spaced one from the other along said tip in communication with the air in said trailing edge cavity for cooling the trailing edge tip and flow directly into a hot gas path of the turbine.

7. A segment according to claim 1 wherein said plenum in said inner wall comprises first and second chambers on opposite sides of an impingement plate in said plenum having a plurality of openings therethrough, said one cavity lying in communication with said first chamber for flowing steam through said impingement plate openings into said second chamber for impingement-cooling of said inner wall, said another cavity lying in communication with said second chamber for returning spent impingement-cooling steam through said another cavity to said outlet.

8. A segment according to claim 1 wherein said plenum includes a chamber for receiving air from said leading edge cavity, an impingement plate having openings therethrough in said plenum for flowing cooling air supplied to said chamber through said openings to impingement-cool said inner wall.

9. A segment according to claim 8 wherein said inner wall has a plurality of holes therethrough for flowing post-impingement cooling air from said plenum through said holes to film-cool the inner wall along said hot gas path.

10. A segment according to claim 1 wherein said leading edge cavity includes an air inlet, said leading edge having a plurality of holes for flowing cooling air from said leading edge cavity through said holes for film-cooling external surfaces of the leading edge of said vane, an air inlet to said trailing edge cavity for flowing cooling air into said trailing edge cavity, said trailing edge having a plurality of holes spaced from one another along the length of the trailing edge in communication with the air in said trailing edge cavity for film-cooling exterior trailing edge surfaces of said vane, said trailing edge cavity including turbulators for inducing turbulent flow in said trailing edge cavity.

11. A turbine vane segment comprising:

inner and outer walls spaced from one another;

a vane extending between said inner and outer walls and having leading and trailing edges, said vane including a plurality of discrete cavities between the leading and trailing edges and extending lengthwise of said vane for flowing cooling mediums;

a pair of said cavities comprising cavities adjacent said leading edge and said trailing edge, respectively, for flowing cooling air to cool respective leading and trailing edges;

at least two of said plurality of cavities disposed between said leading and trailing edge cavities and having insert sleeves therein, said sleeves extending substantially between said inner and outer walls and having openings therethrough, said inner wall including a plenum and said two cavities lying in communication with one another through said plenum;

said outer wall having an inlet for flowing steam into one of said two cavities and an outlet for flowing spent cooling steam from another of said two cavities, the steam in said two cavities flowing through said openings in said insert sleeves for impingement-cooling side walls of said vane;

said leading edge cavity including an air inlet, said leading edge having a plurality of holes for flowing cooling air from said leading edge cavity through said holes for film-cooling external surfaces of the leading edge of said vane;

said holes being angled relative to the length of said vane.

12. A turbine vane segment comprising:

inner and outer walls spaced from one another;

a vane extending between said inner and outer walls and having leading and trailing edges, said vane including a plurality of discrete cavities between the leading and trailing edges and extending lengthwise of said vane for flowing cooling mediums;

a pair of said cavities comprising cavities adjacent said leading edge and said trailing edge, respectively, for flowing cooling air to cool respective leading and trailing edges;

at least two of said plurality of cavities disposed between said leading and trailing edge cavities and having insert sleeves therein, said sleeves extending substantially between said inner and outer walls and having openings therethrough, said inner wall including a plenum and said two cavities lying in communication with one another through said plenum;

said outer wall having an inlet for flowing steam into one of said two cavities and an outlet for flowing spent cooling steam from another of said two cavities, the steam in said two cavities flowing through said openings in said insert sleeves for impingement-cooling side walls of said vane;

said leading edge cavity including an air inlet, said leading edge having a plurality of holes for flowing cooling air from said leading edge cavity through said holes for film-cooling external surfaces of the leading edge of said vane;

said plenum in said inner wall comprising first and second chambers on opposite sides of an impingement plate in said plenum having a plurality of openings therethrough, said one cavity lying in communication with said first chamber for flowing steam through said impingement plate openings into said second chamber for impingement-cooling of said inner wall, said another cavity lying in communication with said second chamber for returning spent impingement-cooling steam through said another cavity to said outlet.

13. A turbine vane segment comprising:

inner and outer walls spaced from one another;

a vane extending between said inner and outer walls and having leading and trailing edges, said vane including a plurality of discrete cavities between the leading and trailing edges and extending lengthwise of said vane for flowing cooling mediums;

a pair of said cavities comprising cavities adjacent said leading edge and said trailing edge, respectively, for flowing cooling air to cool respective leading and trailing edges;

at least two of said plurality of cavities disposed between said leading and trailing edge cavities and having insert sleeves therein, said sleeves extending substantially between said inner and outer walls and having openings therethrough, said inner wall including a plenum and said two cavities lying in communication with one another through said plenum;

said outer wall having an inlet for flowing steam into one of said two cavities and an outlet for flowing spent cooling steam from another of said two cavities, the steam in said two cavities flowing through said openings in said insert sleeves for impingement-cooling side walls of said vane;

said leading edge cavity including an air inlet, said leading edge having a plurality of holes for flowing cooling air from said leading edge cavity through said holes for film-cooling external surfaces of the leading edge of said vane;

said plenum including a chamber for receiving air from said leading edge cavity, an impingement plate having openings therethrough in said plenum for flowing cooling air supplied to said chamber through said openings to impingement-cool said inner wall.

14. A segment according to claim 13 wherein said inner wall has a plurality of holes therethrough for flowing post-impingement cooling air from said plenum through said holes to film-cool the inner wall along said hot gas path.

15. A turbine vane segment comprising:

inner and outer walls spaced from one another;

a vane extending between said inner and outer walls and having leading and trailing edges, said vane including a plurality of discrete cavities between the leading and trailing edges and extending lengthwise of said vane for flowing cooling mediums;

an impingement plate having openings therethrough and spaced outwardly of said outer wall defining a chamber with said outer wall for receiving cooling air through said impingement plate openings for impingement-cooling the outer wall;

a pair of said cavities comprising cavities adjacent said leading edge and said trailing edge, respectively, for flowing cooling air to cool respective leading and trailing edges;

said leading edge cavity including an air inlet, said leading edge cavity having a plurality of holes for flowing cooling air from said leading edge cavity through said holes for film-cooling external surfaces of the leading edge of said vane;

at least two of said plurality of cavities disposed between said leading and trailing edge cavities and having insert sleeves therein, said sleeves extending substantially between said inner and outer walls and having openings therethrough, said inner wall including a plenum and said two cavities lying in communication with one another through said plenum;

said outer wall having an inlet for flowing steam into one of said two cavities and an outlet for flowing spent cooling steam from another of said two cavities, the steam in said two cavities flowing through said openings in said insert sleeves for impingement-cooling side walls of said vane.

16. A segment according to claim 15 wherein said plenum includes a chamber for receiving air from said leading edge cavity, an impingement plate having openings therethrough in said plenum for flowing cooling air supplied to said chamber through said openings to impingement-cool said inner wall.

17. A segment according to claim 16 wherein said inner wall has a plurality of holes therethrough for flowing post-impingement cooling air from said plenum through said holes to film-cool the inner wall along said hot gas path.

18. A turbine vane segment comprising:

inner and outer walls spaced from one another;

a vane extending between said inner and outer walls and having leading and trailing edges, said vane including a plurality of discrete cavities between the leading and trailing edges and extending lengthwise of said vane for flowing cooling mediums;

an impingement plate having openings therethrough and spaced outwardly of said outer wall defining a chamber with said outer wall for receiving cooling air through said impingement plate openings for impingement-cooling the outer wall;

a pair of said cavities comprising cavities adjacent said leading edge and said trailing edge, respectively, for flowing cooling air to cool respective leading and trailing edges;

at least two of said plurality of cavities disposed between said leading and trailing edge cavities and having insert sleeves therein, said sleeves extending substantially between said inner and outer walls and having openings therethrough, said inner wall including a plenum and said two cavities lying in communication with one another through said plenum;

said outer wall having an inlet for flowing steam into one of said two cavities and an outlet for flowing spent cooling steam from another of said two cavities, the steam in said two cavities flowing through said openings in said insert sleeves for impingement-cooling side walls of said vane;

said leading edge cavity including an air inlet, said leading edge having a plurality of holes for flowing cooling air from said leading edge cavity through said holes for film-cooling external surfaces of the leading edge of said vane.

19. A segment according to claim 18 wherein said outer wall has a plurality of holes for flowing post-impingement air from said chamber holes therethrough for film-cooling the outer wall along a hot gas path of the turbine.

* * * * *